United States Patent [19]

Staples

[11] 4,136,048

[45] Jan. 23, 1979

[54] FLUID HYDROCARBON OIL COMPOSITIONS CONTAINING BLOCK COPOLYMERS FOR IMPROVED VISCOSITY TEMPERATURE RELATIONSHIP

[75] Inventor: Thomas L. Staples, Midland, Mich.

[73] Assignee: The Dow Chemical Company, Midland, Mich.

[21] Appl. No.: 539,468

[22] Filed: Jan. 8, 1975

[51] Int. Cl.[2] ..... C10M 1/16

[52] U.S. Cl. ..... 252/59

[58] Field of Search ..... 252/59

[56] References Cited

U.S. PATENT DOCUMENTS 3,318,813 5/1967 McCormick et al. ..... 252/59

*Primary Examiner*—Delbert E. Gantz
*Assistant Examiner*—Andrew Metz

[57] ABSTRACT

A fluid having an improved viscosity/temperature relationship results from a blend of that fluid and a block copolymer having an AB configuration wherein the A portion is a polymeric structure that is insoluble in said oil below a characteristic temperature and soluble above that temperature and the B portion is a polymeric structure that is soluble in said fluid over the complete range of temperature for which the liquid composition will be used and wherein the chain length of said B portion is small relative to that of said A portion. Fluid compositions having a relatively constant viscosity over an extended temperature range result when two or more such block polymers are blended with the fluid.

11 Claims, 2 Drawing Figures

Figure 1:
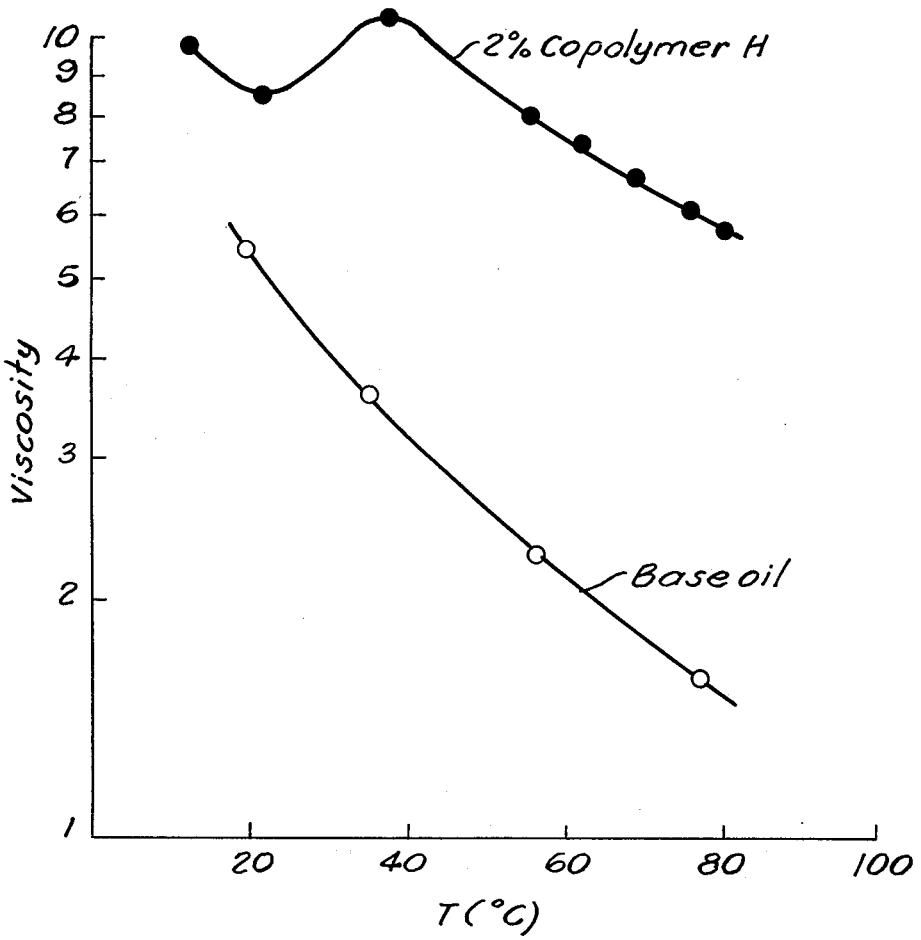

FLUID HYDROCARBON OIL COMPOSITIONS CONTAINING BLOCK COPOLYMERS FOR IMPROVED VISCOSITY TEMPERATURE RELATIONSHIP

BACKGROUND OF THE INVENTION

Through the years there has been considerable interset in materials that can be added to fluids such as hydrocarbon oils, as exemplified by lubricating oils, to improve their viscosity/temperature relationships. In this regard it has been well known to employ various polymeric materials as those additives. Included among such polymeric materials are the high molecular weight polymers and copolymers of acrylate and methacrylate esters, styrene, alkylstyrene, and olefins such as isobutylene.

The Prior Art

U.S. Pat. No. 2,572,558 teaches the use of propylated polystyrene for increasing the viscosity index of lubricating oil. The objective is achieved when each styrene unit on the average has at least 1.5 isopropyl substituents.

U.S. Pat. No. 3,318,813 is concerned with improving the viscosity index of lubricating oils with polymers and copolymers of nuclear substituted alkyl styrene where the alkyl group contains from 3 to 8 carbon atoms. The useful polymers are those with a narrow molecular weight distribution.

U.S. Pat. No. 3,668,125 and 3,763,044 relate to soluble viscosity index improvers for lubricating oils using block copolymers of hydrogenated monovinyl arene polymers and of alpha olefin polymers or hydrogenated conjugated diene polymers.

Tetrahydrofurfuryl methacrylate polymers used as additives for oil are taught in U.S. Pats. Nos. 3,311,559; 3,311,597; and 3,321,405.

Moderately crosslinked polymers of allyl esters of unsaturated carboxylic acids are employed as oil additives in U.S. Pat. No. 3,222,282.

SUMMARY OF THE INVENTION

The present invention is a fluid, such as a liquid hydrocarbon oil, composition having an improved or even constant viscosity/temperature relationship. The composition comprises a fluid and one or more block copolymers having an AB configuration wherein the A portion is a polymeric structure that is insoluble in said fluid below a characteristic temperature and soluble above that temperature and the B portion is a polymeric structure that is soluble in said fluid over the complete range of temperature for which the liquid composition will be used and wherein the chain length of said B portion is small relative to that of said A portion. The polymers are unique in exhibiting a reversible solution-/emulsion phase transistion that is temperature dependent. The temperature at which the composition passes from a solution to a colloidal dispersion shall be referred to herein as the transition temperature.

The fluids useful herein represent a wide variety of functional fluids such as hydrocarbon oils including mineral and synthetic oils, lubricating oil, diesel oil, hydraulic oil, automatic transmission oil and the like.

The useful polymers are those block copolymers particularly of a monoalkenyl aromatic structure. The polymers are also characterized by an AB structure.

The A portion is a polymeric structure or block that is insoluble in the fluid below a characteristic temperature and soluble above that temperature. Typical of such blocks are linear structures of polystyrene or of copolymers of styrene and nuclear alkylated styrene where the alkyl group contains from about 3 to 8 carbon atoms. The A blocks may also include significant amounts of comonomers such as alpha methyl styrene, chlorostyrene or like materials. Other copolymeric systems that may be useful include the anionic block copolymers of styrene and butadiene or isoprene that have been hydrogenated to saturate the polydiene block. Also styene-isobutylene cationic block coploymers may find use with some fluids.

The molecular weight of the A portion is not critical. However for use in the present invention the molecular weight should be high enough to make the desired contribution to the visocity of the fluid and low enough to be soluble in that fluid. The most useful molecular weight in any given instance will vary depending on the fluid and the polymer. Although the molecular weight of copolymer to be used herein cannot be expressed in precise numerical terms, generally a number average molecular weight of from about 100,000 to 500,000 will be most advantageous.

The optimum choice of polymer structure for the A portion will be easily determined by routine solubility tests which will provide the transistion temperature which in turn will permit an approximation of the temperature range over which the block copolymers will be influential in controlling the viscosity.

The B portion of the block polymer is a polymeric structure that by itself is soluble in the oil over the complete range of temperatures for which it is desired to maintain the constant viscosity/temperature relationship. This B portion particularly may be a hydrocarbon such as a polyalkylated styrene including, for example, poly t-butylstyrene. The molecular weight of the B portion should be small relative to the A portion, advantageously being from about 10,000 to about 50,000.

The block copolymers can be prepared by anionic polymerization as taught, for example, in U.S. Pat. No. 3,041,312. Typically the polymerization is carried out in the presence of a monofunctional anionic catalyst, such as n-butyl lithium or cumyl potassium. The polymerization is conducted in a solvent such as tetrahydrofuran, benzene, dioxane, alkane hydrocarbons or other aprotic solvent. The reaction may be customarily initiated at about room temperature which then rises rapidly as polymerization occurs. The reaction usually is completed in a short time period, frequently a matter of a few minutes. By means of such polymerization polymers having a narrow molecular weight distribution and a predetermined molecular weight can be prepared.

In a typical example the block copolymers of this invention were prepared by anionic polymerization of styrene and t-butylstyrene in tetrahydrofuran with n-butyl lithium. Since moisture and oxygen are terminating agents in anionic systems, their absolute removal is imperative. A small manifold was used to deliver scrubbed plant nitrogen to the apparatus, and an exit manifold was connected to a silicone oil bubbler to allow a few centimeters over-pressure. The nitrogen, after passing through silica gel, was scrubbed with a solution of polystyryl lithium (>0.1M) in benzene containing a small amount of tetrahydrofuran. The added tetrahydrofuran affords more ion dissociation and thus greater reactivity and more efficient scrubbing.

A dropping funnel contained the initiator solution, ~0.1M polystyryl lithium in benzene prepared by adding 5 ml of 1.6M BuLi/hexane to 75 milliliters dry benzene followed by 1 ml dry styrene. All additions were made with hypodermic syringes through rubber septums. Another funnel contained the monomer mixture. A tube passing to the bottom of this monomer funnel allowed purging and mixing of the monomers as the nitrogen flushed through the apparatus. The monomer funnel was jacketed to allow cooling the monomers during titration.

Tetrahydrofuran was refluxed over $CaH_2$ for 1–3 days under slow nitrogen sweep. After placing up to 1200 milliliters of tetrahydrofuran in the reflux flask it was not necessary to open any portion of the apparatus to the atmosphere until several runs had been completed.

A polymerization run was begun with distillation of about 300 ml of tetrahydrofuran into the reaction flask; the slow nitrogen sweep is maintained throughout. During the distillation the initiator solution was prepared. The distilled tetrahydrofuran was titrated for damaging impurities by carefully adding a small amount of 1.6M BuLi/hexane, while stirring, until a very pale yellow color persisted for several minutes; generally less than a milliliter was required. If the color slowly fades a few drops of the initiator solution will bring it back. Then the color is due to polystyryl lithium, but in dilute solution it is similar.

The monomers, previously distilled from $CaH_2$ on a rotary evaporator and stored under nitrogen, were then introduced with a syringe. The composition was measured on a volume basis. In this example 20 milliliters of styrene and 10 milliliters of t-butyl styrene were used yielding an A block of 67 S/33 TBS composition. After about ½ hour of bubbling nitrogen through the monomer mixture, it too was titrated for impurities with the initiator solution using a syringe. Generally 3 milliliters was sufficient.

The initiator solution in the amount of 0.8 milliliter (~0.08 mmoles) was added with a 2 milliliter syringe directly into the reaction flask. This is the initiator for the polymerization. Dropwise addition of the monomer was immediately begun. The addition continued for about 15 minutes; the heat of polymerization raised the temperature to about 40° C. This was moderated by slowing the addition rate. An occasional drop of initiator solution was added to the monomer feed throughout the addition to prevent spurious termination in the reactor. The viscosity quickly increased since the rate of polymerization is fast relative to the addition rate.

After addition was complete the solution was viscous and orange. Polymerization was complete within five minutes of complete addition and 2 milliliters of t-butyl styrene was added dropwise directly into the pot with a syringe. This formed the poly(TBS) tail or B block. After a few minutes the stirrer was stopped. The polymer was terminated and the solution recovered by drawing it out the bottom into an evacuated flask containing a few drops of water. Evacuation is necessary both to move the viscous solution and to prevent appreciable oxygen termination, which can lead to colored products. Water terminates the carbanionic chain by simple protonation.

The polymer was precipitated from the tetrahydrofuran solution by slowly adding it to methanol in an air-driven Waring Blendor. About 4 aliquots of ~75 ml of solution were used, each with ~300 ml of methanol. The total slurry was then filtered and the polymer washed with about 300 ml methanol and refiltered. Overnight drying in a vacuum oven at room temperature left a dry fibrous product. The yield was quantitative.

The nominal molecular weight of each block in the copolymer was calculated.

The fluid/copolymer compositions are readily prepared by adding the copolymer to the fluid, while being stirred, held at a temperature above that at which portion A of the copolymer is insoluble.

The amount of block copolymer to be used is the minimum to be effective in controlling the viscosity/temperature relationship of the fluid composition to the extent desired within the temperature range within which control is required. The actual amount used will depend on a number of factors including the copolymer composition and molecular weight, the particular fluid and the requirements of the application of the composition. Generally an amount in the range of from about 1 to 10 weight percent copolymer in the composition will suffice. The optimum amount will be readily determined by simple preliminary tests.

Each such block copolymer provides a measure of viscosity control. FIG. 1 of the attached drawings illustrates the typical pattern of influence of a single block copolymer. In the illustrated case the viscosity is relatively constant through the minimum and maximum between about 20° C. to 40° C. The transition temperature of the illustrated polymer was about 35° C. The polymers influence above about 40° C. shows a control of the viscosity/temperature relationship.

Figure 2:
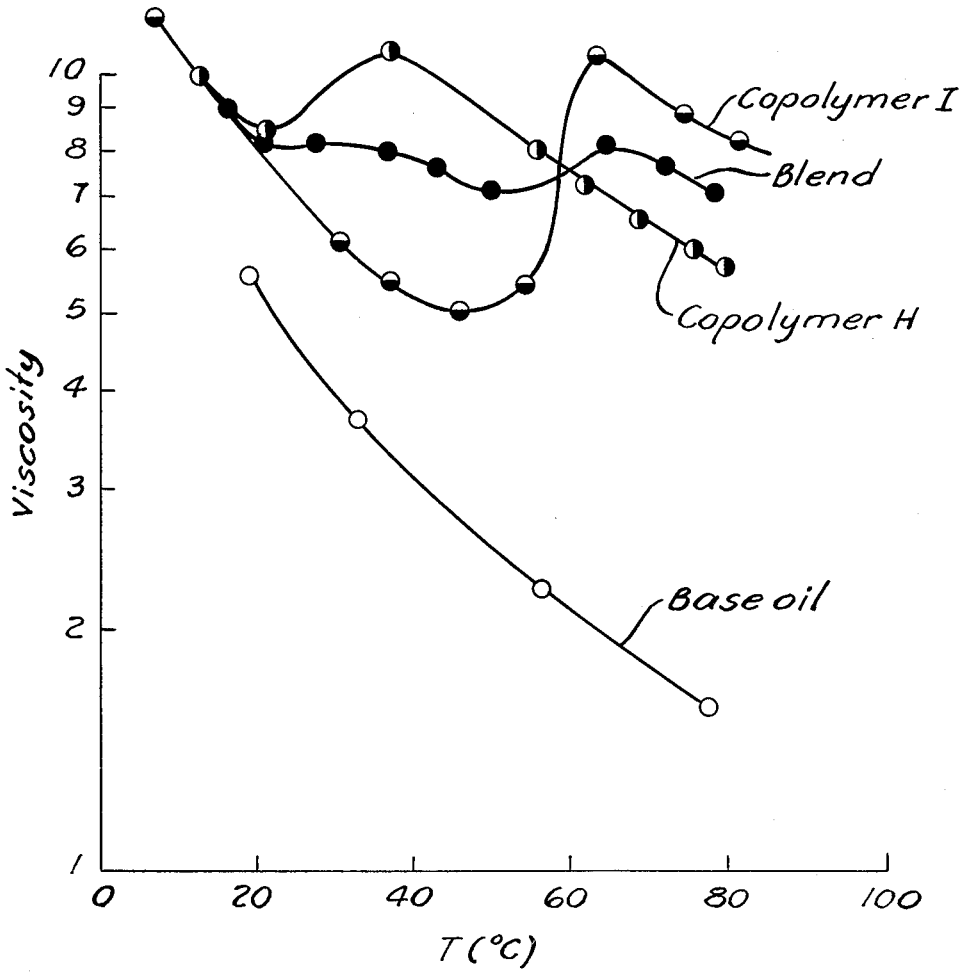

FIG. 2 illustrates the additive effect on viscosity/temperature relationship of the influence of two block copolymers in a hydrocarbon oil. The net result is an oil composition having a constant viscosity from about 20° C. to about 80° C.

By suitable selection of block copolymers it is possible to obtain constant viscosity between desired extremes of temperature. The selection is most conveniently made from a comparison of transition temperatures of the various block copolymers. Usually if a wide range of viscosity control is desired, it will be easy from observation of transition temperatures of individual block copolymers to make judicious selection.

The effects exhibited by the block copolymers are reversible through the range of temperature for which they are designed. That behavior results from the unique structure as defined wherein the small soluble B portion holds the block polymer in colloidal dispersion. The behavior is in contrast to prior polymeric viscosity controlling agents which functioned in that capacity throughout the temperature range in which they were soluble but below which they settled out of solution. When settled out of solution not only is such a polymer incapable of exerting influence on the viscosity of the oil but in addition presents problems of clogging filters, small oil lines and like mechanical devices. The stable colloidal dispersion of this invention results in particles of submicron size which continue to exert an influence on the oil but minimize the mechanical difficulties.

The invention will be more apparent from the following examples which are for illustrative purposes only. All parts and percentages are by weight.

EXAMPLE 1

A number of block copolymers were prepared by the technique earlier mentioned. Those copolymers were evaluated for transition temperature in a light hydrocarbon oil sold commercially as Calumet 3800 by Citgo. The oil compositions were heated and cooled to determine the state of the copolymer below the transition temperature. The results are shown in Table I. In all cases the copolymer/oil compositions of this invention became stable emulsions below the transition temperature while in all cases the copolymers lacking a B portion precipitated and settled out of solution. The emulsions of the compositions of this invention remained stable for several months as shown by no visible sediment even after storage in a freezer below 0° C.

TABLE I

AB BLOCK COPOLYMERS

| Sample | A Block Wt % S/TBS | A Block Calc. $10^{-5}$ M | B Block Calc. $10^{-5}$ $M_n$ | Total $10^{-5}$ M Calc | $T_{trans}$ C-3800(° C) |
|---|---|---|---|---|---|
| This Invention | | | | | |
| A | 67/33 | 4.9 | 0.36 | 5.3 | 35–40 |
| B | 75/25 | 3.0 | 0.15 | 3.15 | ~55 |
| C | 80/20 | 3.0 | 0.15 | 3.15 | ~65 |
| D | 20/80 | 3.55 | 0.14 | 3.7 | <25 |
| E | 40/60 | 3.55 | 0.14 | 3.7 | <25 |
| F | 33/67 | 3.55 | 0.14 | 3.7 | <25 |
| G | 47/53 | 3.55 | 0.14 | 3.7 | <25 |
| H | 67/33 | 3.4 | 0.22 | 3.6 | ~35 |
| I | 80/20 | 3.4 | 0.22 | 3.6 | ~65 |
| In Contrast | | | | | |
| J | 70/30 | 5.4 | — | 5.4 | — |
| K | 67/33 | 4.9 | — | 4.9 | 35–40 |
| L | 83/17 | 2.7 | — | 2.7 | 92–94 |

EXAMPLE 2

The viscosity/temperature relationship was determined on a sample of Calumet 3800 oil by heating the sample and periodically taking viscosity measurements using a Ubbelohde tube in a bath controlled to within 0.5° C.

An amount of the block copolymer identified in Example 1 as H dissolved in the oil at 120° C. to give a 2 percent solution. The viscosity determinations were repeated.

The results are shown graphically in FIG. 1 of attached drawings.

EXAMPLE 3

A hydrocarbon oil composition was prepared by dissolving at 120° C. one percent of copolymer H and 1.65 percent of copolymer I. Viscosity determinations were made as in Example 2.

In contrast a similar composition was made with two percent of copolymer H and another with 3.3 percent of copolymer I. Viscosity determinations were made.

The results are shown graphically in FIG. 2 where the curve resulting from the blend of two copolymers indicates a relatively constant viscosity over the range from 20° C. to 80° C. while the compositions with only one copolymer show some fluctuation in viscosity and viscosity control over only a part of the temperature range. All compositions show improvement over the base oil.

What is claimed is:

1. A liquid composition exhibiting reversible solution-/emulsion phase transition to provide an improved viscosity/temperature relationship, said composition comprising a liquid hydrocarbon oil and a block copolymer having an AB configuration wherein the A portion is a polymeric structure of a polymerized alkenyl aromatic monomer wherein said structure is insoluble in said oil below a transition temperature and soluble above that temperature and the B portion is a polymeric structure of a poly alkylated styrene wherein said structure is soluble in said fluid over the complete range of temperature for which the liquid composition will be used and wherein the molecular weight of the chain length of said B portion is from about 10,000 to 50,000 and is small relative to that of said A portion which has a molecular weight of from about 100,000 to 500,000.

2. The composition of claim 1 wherein said hydrocarbon oil is a lubricating oil.

3. The composition of claim 1 wherein said alkenyl aromatic monomer is styrene.

4. The composition of claim 1 wherein A portion of said block polymer consists of copolymerized styrene and t-butyl styrene.

5. The composition of claim 1 wherein said B portion of said block polymer consists of homopolymerized t-butylstyrene.

6. A liquid composition exhibiting reversible solution-/emulsion phase transition to provide an improved viscosity/temperature relationship, said composition comprising a liquid hydrocarbon oil and at least two block copolymers each having an AB configuration wherein the A portion is a polymeric structure of a polymerized alkenyl aromatic monomer wherein said structure is insoluble in said oil below a transition temperature and soluble above that temperature and the B portion is a polymeric structure of a poly alkylated styrene wherein said structure is soluble in said oil over a complete range of temperature for which the liquid composition will be used and wherein the molecular weight of the chain length of said B portion is from about 10,000 to 50,000 and is small relative to that of said A portion which has a molecular weight of from 100,000 to 500,000 and wherein the transition temperature of each copolymer differs from that of each of the other polymers.

7. The composition of claim 6 wherein said hydrocarbon oil is a lubricating oil.

8. The composition of claim 7 wherein said alkenyl aromatic monomer is styrene.

9. The composition of claim 7 wherein A portion of said block polymer consists of copolymerized styrene and t-butyl styrene.

10. The composition of claim 6 wherein said B portion of said block polymer consists of homopolymerized t-butylstyrene.

11. The composition of claim 6 wherein the transition temperature of each polymer differs from that of each other polymer by at least 10 degrees Centrigrade.

* * * * *